United States Patent [19]

Brownell

[11] 3,997,858

[45] Dec. 14, 1976

[54] COORDINATE SWITCH CONSTRUCTION

[75] Inventor: Richard Miller Brownell, Upper Arlington, Ohio

[73] Assignee: Bell Telephone Laboratories, Incorporated, Murray Hill, N.J.

[22] Filed: Nov. 24, 1975

[21] Appl. No.: 634,482

[52] U.S. Cl. ..... 335/112; 335/196

[51] Int. Cl.[2] ..... H01H 67/26

[58] Field of Search ..... 335/112, 196; 200/176; 340/166 R, 166 C, 166 CE

[56] References Cited

UNITED STATES PATENTS

| | | | |
|---|---|---|---|
| 3,025,502 | 3/1962 | Gellert | 340/166 CE |
| 3,027,548 | 3/1962 | Vaughan | 340/166 CE |
| 3,268,840 | 8/1966 | Hjertstrand | 335/112 |
| 3,753,176 | 8/1973 | Regnier et al. | 335/112 |

*Primary Examiner*—Harold Broome
*Attorney, Agent, or Firm*—William H. Kamstra

[57] ABSTRACT

A coordinate electrical switch construction comprising a pair of flexible insulating sheets each havng pierced therethrough a coordinate array of "U" shaped magnetic contact elements arranged to have corresponding legs in opposing, spaced-apart registration. Winding means coupled to the contact elements in each set of coordinates on each sheet are coincidently energisable to selectively magnetize a pair of elements at a crosspoint to bring opposing legs into electrical contact against the flexion of the sheets. The contact elements are multiplied together in one and the other sets of coordinates on respective sheets to provide signal path halves which are completed upon contact leg closure at a crosspoint. The contact elements are of a remanent magnetic material so that closure is maintained after termination of the energizing step. Release of selected crosspoint elements is achieved by reverse energization of the defining winding means.

10 Claims, 4 Drawing Figures

COORDINATE SWITCH CONSTRUCTION

BACKGROUND OF THE INVENTION

This invention relates to electromagnetically actuated electrical switch devices and more particularly to such devices generally characterized as crossbar switches presenting a coordinate array of electrical contacts.

Coordinate array electrical switches of the crossbar type in which electrical contacts are selectively operated by mechanical means responsive to electro-magnetic control have long constituted the basic switch unit of many telephone switching networks. Such switch units are widely used, for example, in the Bell System No. 5 switching system. Other coordinate switch arrangements providing metallic electrical contacts are also known. Miniature sealed reed switches as crosspoint elements, for example, are extensively employed in the more recent electronic telephone switching systems. Although considerable interest is presently being shown in the art in solid state coordinate switches, switches providing for the metallic contact control of circuit paths still offer a number of advantages in terms of transmission quality, reliability, and ease of maintenance, for example. The latter switches could be made even more attractive if their size and initial cost of fabrication were reduced and their construction simplified and efforts in the art to these ends also are known.

In the patent of S. L. Hjertstrand, U.S. Pat. No. 3,099,727, issued July 30, 1963, for example, is disclosed a coordinate switch arrangement in which a plurality of horizontal and vertical flexible, electrically conductive, magnetic strips intersect to define the coordinate array crosspoints and to constitute the controlled conducting paths. At a typical crosspoint a pair of magnetic contact plugs is affixed to one strip without making contact with the intersecting strip. A second plurality of horizontal and vertical conductive operating strips are mounted respectively on the magnetic strips to intersect between the contact plugs at each crosspoint. Briefly, when a selected pair of coordinate operating strips are energized by coincident currents, a resultant magnetic field closes through the intersecting magnetic strips and the crosspoint contact plugs to flex the magnetic strips toward each other at that point thereby bringing the plugs into electrical contact with the magnetic strip from which it is normally spaced apart. An electrical circuit is thus completed which remains closed as the result of the remanent character of the elements defining a crosspoint.

The foregoing prior art arrangement has been described in some detail for the purpose of providing a specific background and point of departure for the coordinate switch according to the present invention which is also directed to the problem of achieving a structurally simpler, more readily fabricated, and more economical crosspoint switch construction.

It is accordingly an object of this invention to simplify the construction of a coordinate switch beyond that hitherto possible and to achieve such a construction which more advantageously lends itself to automated fabrication techniques.

It is also an object of this invention to provide a new and novel coordinate switch construction which makes possible a significant increase in speed of operation compared to electromechanical crossbar switches and reduction in physical size compared to most coordinate switches.

SUMMARY OF THE INVENTION

The foregoing and other objects of this invention are realized in one specific embodiment thereof comprising a pair of electrically insulating, flexible rectangular sheets maintained in parallel and spaced apart, congruent planes, which sheets form the supporting members for the switch electrical contact elements. On the opposite surfaces of each of the sheets are respectively affixed a first and a second plurality of energizing conductors, the pluralities of conductors on the opposite surfaces being arranged respectively in intersecting coordinates to define an array of crosspoints on each sheet. At each of the crosspoints on each sheet is mounted a contact element which takes the form of a substantially "U" shaped, staple-like member made of an electrically conductive, remanent magnetic material. The U-shaped members pierce the sheets from their opposite surfaces to enclose at the crosspoints the energizing conductors there affixed at their intersections so that at each crosspoint the legs of the two opposing contact elements are in alignment with their ends slightly spaced apart.

On the opposite surfaces of the supporting sheet pair, the bases of the U-shaped contact elements are electrically connected to conductors lying in the respective intersecting coordinates of the switch array. This multipling of contact elements thus presents in each coordinate on each sheet one-half of a signal path. The sheets are spaced so that, in one embodiment, as they are mutually flexed toward each other at a cross-point, the open-ended legs of the two contact elements make electrical contact to complete the two halves of a signal path on the sheets. The mutual flexing of the sheets at a crosspoint is accomplished by the selective coincident current energization of the defining coordinate energizing conductors on each sheet to cause opposite magnetic poles at the opposing legs of a contact element, the attracting magnetomotive forces drawing the sheets together. The remanent magnetic properties of the elements maintain the contacts closed after termination of the selecting currents. Release of a connection is accomplished by the oppositely poled energization of single coordinate energizing conductors to cause repelling poles at the contact element legs.

As generally described in the foregoing, a coordinate switch arrangement according to this invention readily lends itself to a maximum use of printed wiring and flex circuit techniques. According to another feature of the switch, twin contacts are provided at each cross-point for each circuit completion to ensure maximum contact reliability. Other features and fabrication feasibilities will become apparent from a more detailed consideration of a switch according to this invention hereinafter.

BRIEF DESCRIPTION OF THE DRAWING

The organization and operation of this invention together with its objects and features will be better understood from a consideration of the detailed description of one illustrative embodiment thereof which follows when taken in conjunction with the accompanying drawing in which.

DETAILED DESCRIPTION

Figure 1:
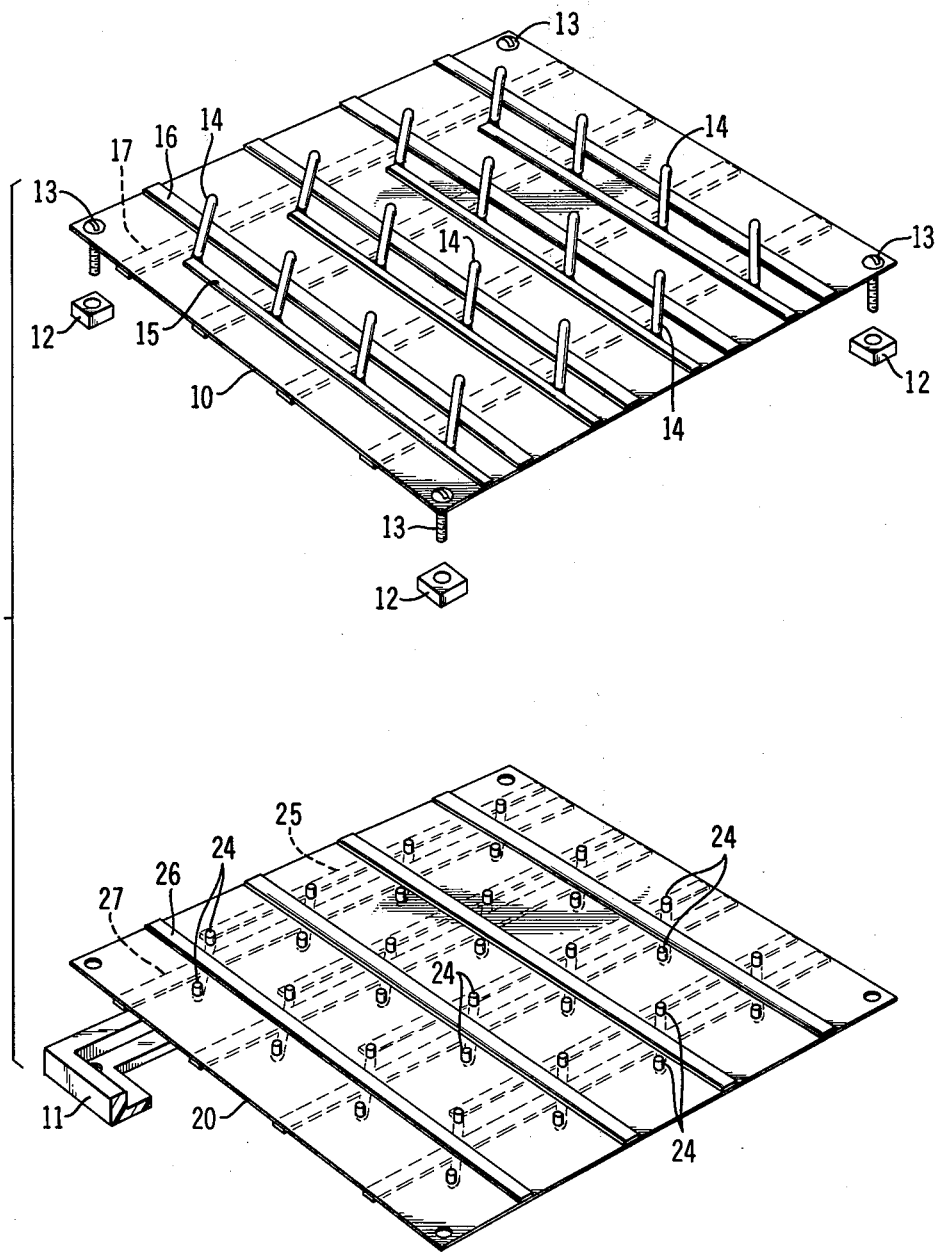
FIG. 1 depicts in three-quarter perspective and exploded view a coordinate switch construction embodying the principles of this invention, simplified to a four-by-four array.

An exploded view of an illustrative switch construction according to this invention is shown in FIG. 1, the construction comprising a first and a second flexible rectangular sheet 10 and 20 maintained in parallel planes in a congruent, spaced apart relationship. The relative position of the sheets 10 and 20, shown in the exaggerated spacing of an exploded view, when assembled, may be maintained by any suitable supporting and spacing frame, such as the frame 11 and spacers 12, shown in the figure as partially encasing the sheets, and mounting screws 13. The sheets 10 and 20 are formed of an electrically insulating material such as that commercially available as the Type 6550 flex circuit material from the Minnesota Mining and Manufacturing Company, for example. Each of the sheets 10 and 20 mounts a coordinate array of contact elements 14 and 24 to present a coordinate array of crosspoint halves on each sheet. Although only four-by-four arrays are shown in FIG. 1, any number of crosspoints may be provided for in a switch construction as dictated by network requirements, the sixteen crosspoint arrangement being sufficient for an understanding of the invention.

Figure 2:
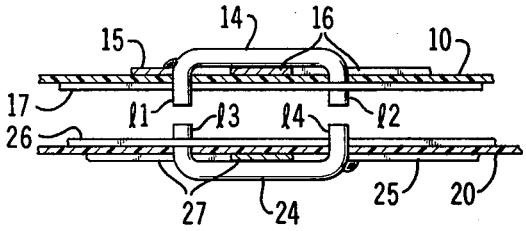
FIG. 2 shows in section view the element details of a single circuit completion point of an exemplary crosspoint of FIG. 1.

The character of the contact elements 14 and 24 and the manner in which the elements are mounted on the sheets 10 and 20 are more clearly seen in the section view of FIG. 2 where one opposing pair of elements 14 and 24 of an exemplary crosspoint is presented. Each of the elements 14 and 24 comprises a U-shaped, staple-like member formed of an electrically conductive, remanent magnetic material such as that commercially known as Remendur, for example. The elements 14 and 24 pierce the sheets 10 and 20 from opposite surfaces to present four opposing and aligned legs, such as the legs *l*1, *l*2, *l*3, and *l*4 of the elements 14 and 24 of FIG. 2. These legs may be clinched or otherwise arranged and shaped to provide desirable combinations of magnetic pole and electrical contact properties. The contact elements 14 and 24 are conveniently diagonally arranged on the mounting sheets to accommodate energizing conductors to be described and may be fixedly maintained by any suitable cementing means known in the art. Alternatively, they may be supported so as to have limited motion, thus allowing a self-aligning action and compensation for any insufficient flexibility of the sheets.

As seen with respect to the upper sheet 10 of FIG. 1, the elements 14 lying in the coordinates there visible are electrically multipled by main circuit conductors 15 to which they are suitably soldered or otherwise electrically connected. The corresponding elements 24 on the lower sheet 20 are similarly multipled by conductors 25 in intersecting coordinates lying on the under surface of sheet 20 as viewed in the drawing. The conductors 15 and 25 take the form of flexible flat strips which may be affixed to the sheets 10 and 20, respectively, in any convenient manner known in the art. These conductors may terminate at one edge of the assembly at suitable terminal means adapted for external interconnection as is well known in the art. Since such terminals and interconnections as well as others to be assumed do not comprise essential aspects of this invention, they need not be more fully described here.

The sheets 10 and 20 also mount coordinate arrangements of energizing conductors on their surfaces for the coincident current selection of the crosspoints. Thus, the sheet 10 has arranged thereon in vertical coordinates on its upper surface as viewed in the drawing, a plurality of energizing conductors 16; the sheet 20 has correspondingly arranged thereon a plurality of energizing conductors 26 on its upper surface. Similarly, the sheets 10 and 20 have arranged in intersecting coordinates on their under surfaces as viewed in the drawing, second pluralities of energizing conductors 17 and 27, respectively. The conductors 16, 17, 26, and 27 may also comprise flexible flat strip conductors affixed to the respective surfaces of sheets 10 and 20 in any convenient manner. As more clearly shown in the single crosspoint section view of FIG. 2 including only portions of these conductors, the flat strip energizing conductors intersect and pass between the open-ended legs *l*1–*l*2 and *l*3–*l*4 of elements 14 and 24, respectively. The energizing conductors in practice are typically connected at one end to current sources of the system in which a switch according to this invention is advantageously adapted for use. These sources are readily envisioned by one skilled in the art and need not be further considered here beyond characterizing the nature of the currents required for an illustrative operation of the switch hereinafter. In the dual flexible sheet embodiment just described it is apparent that the two sheets with their mounted electrical circuits and contact elements are advantageously identical. Thus, an upper sheet may be used in the lower position simply by reversing its surfaces and rotating it 90° in its plane. The advantages of such an interchangeability from a mass production standpoint will be readily appreciated.

Figure 3:
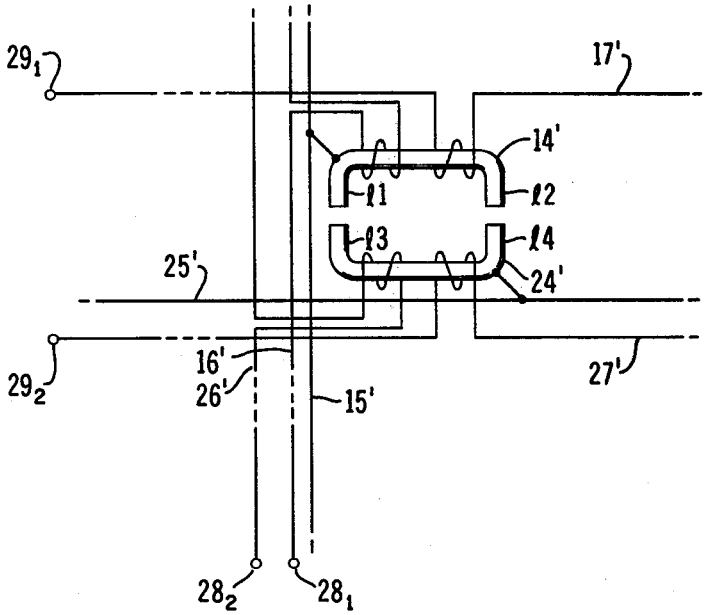
FIG. 3 depicts schematically the equivalent electrical winding arrangement of an illustrative crosspoint of the switch of FIG. 1.

An illustrative operation of the switch arrangement according to this invention may now be described with particular reference to the schematic diagram of a typical crosspoint shown in FIG. 3. Although in the foregoing the energizing selection conductors are contemplated as simply passing between the legs of the contact elements, the magnetic coupling of these conductors and elements is shown in the latter figure as being achieved by windings for purpose of description only. In that figure a typical crosspoint including the contact element pair 14′–24′ is defined by the coordinate energizing conductor pairs 16′–26′ and 17′–27′ shown as inductively coupled to the contact element pair by windings on their base legs. The crosspoint of FIG. 3 is considered as representative of any crosspoint of the switch array and the description of its selection will be understood as applying equally to the selection of any other crosspoint of the switch. It will be assumed that as the result of a previous release operation, the legs of the contact element pair 14′–24′ as well as those of the other elements of the array are all separated to present open circuit states. To accomplish the selection of the crosspoint of FIG. 3, positive current pulses are coincidently applied to the conductors 16′, 26′, 17′, and 27′ which may be achieved via terminals $28_1$, $28_2$, $29_1$, and $29_2$, respectively.

These current pulses generate at the elements 14′ and 24′ magnetic fields to cause opposite magnetic poles at the ends of the legs *l*1–*l*2 and *l*3–*l*4, respectively. The magnitude of the applied current pulses is determined so that, in view of the coercivity of the contact elements and the spacing of the opposing legs, the magnetic poles exert sufficient attractive forces to draw the opposing legs into electrical contact, the sheets 10 and 20 offering sufficient flexibility at the selected crosspoint to permit an exclusive selection. The contact elements 14' and 24' thus brought into contact, complete a connection between the main coordinate circuit conductors 15' and 25'. It may be noted here that at each crosspoint, two electrical contact points are closed for each circuit completion, thus enhancing the reliability of a crosspoint. Because of the remanent magnetic characteristics of the contact elements 14' and 24', the elements will remain in electrical contact after termination of the applied coincident current pulses until subsequently released. The selection of a particular crosspoint to the exclusion of others lying on the same coordinates is conventionally achieved by maintaining the magnitudes of each of the coincident selection currents below that required to switch the magnetic state of a contact element. It will thus be only at a selected crosspoint that the fields generated coact to cause a switching of the magnetic states of the contact elements there. Selective release of a crosspoint connection is accomplished by applying negative current pulses to one pair of the terminal pairs $28_1$–$29_1$ and $28_2$–$29_2$ and coincidentally positive current pulses to the other pair. The switching of either element 14' or 24' will restore repelling poles at the opposing legs thereby forcing the separation of the contacts aided by the restoring flexion of the sheets 10 and 20.

Figure 4:
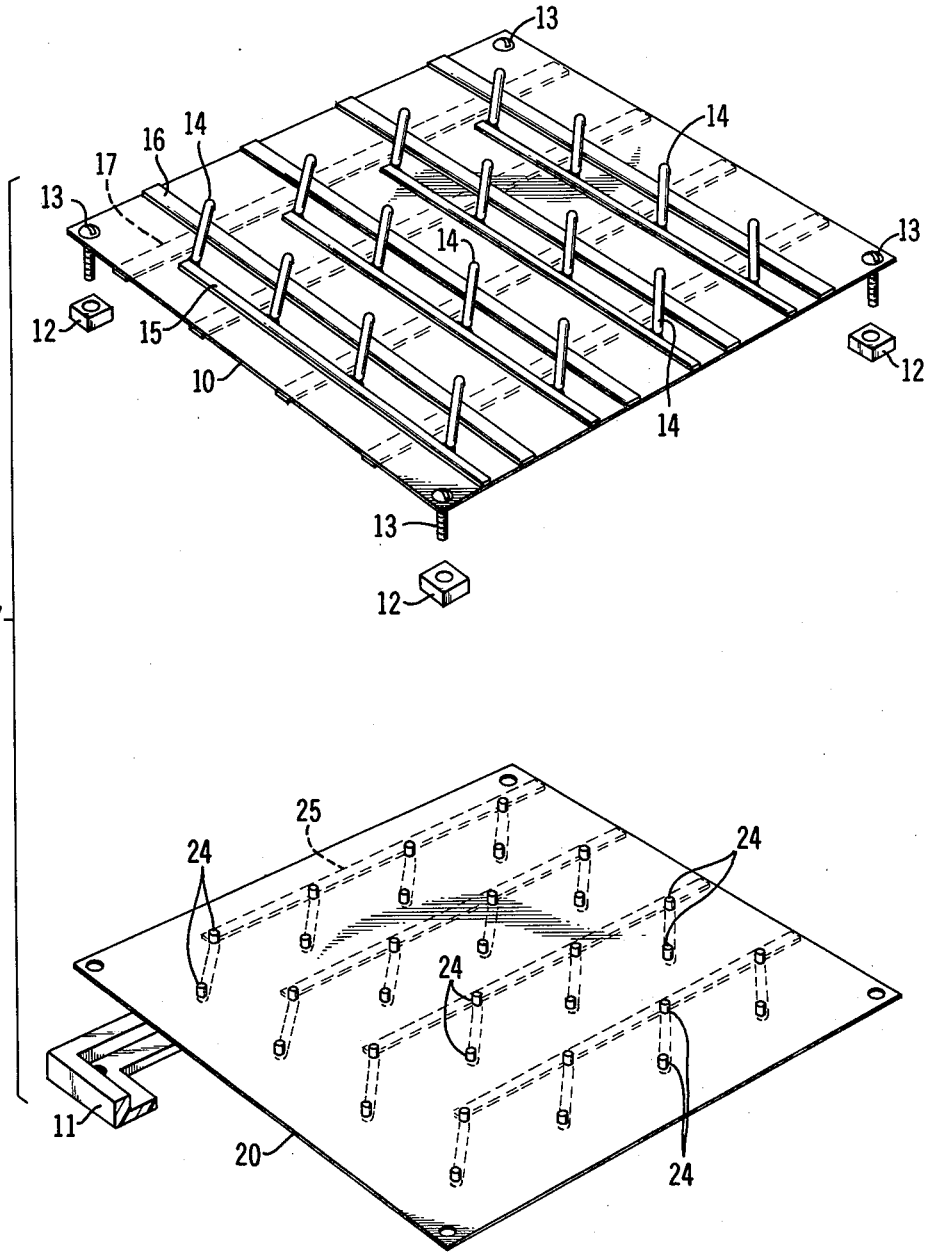
FIG. 4 depicts a modification of the switch construction of FIG. 1 as an alternate illustrative embodiment of this invention.

From the description of the details and operation of one illustrative embodiment of this invention in the foregoing, it will be apparent that numerous modifications may be made therein by one skilled in the art within the scope of the invention. Thus, although in particular applications of the switch it may be desirable to provide for the switching of both elements 14 and 24 in a selection operation (as in the embodiment of FIG. 1), the switch may also be operated by the selection of a single set of energizing conductors such as the conductors 16' and 17' alone or the conductors 26' and 27' alone. Another illustrative embodiment according to this invention operated in this manner is shown in FIG. 4. In the switch embodiment there shown only the upper sheet is provided with coordinate energizing conductors, the contact elements of the lower sheet being permanently magnetized to present appropriate magnetic poles. The embodiment of FIG. 4 need not be described in greater detail since, except for these differences, its organization is identical to that of FIG. 1, identical elements being designated by the same reference characters. The selection of a crosspoint in the embodiment of FIG. 4 may be described also with reference to the schematic diagram of FIG. 3. For this purpose it will be assumed that the element 24' is permanently magnetized to present opposite magnetic poles at the legs *l*3 and *l*4 and the conductors 26' and 27' are ignored. The energizing conductors 16' and 17' are now coincidently energized to create poles at the legs *l*1 and *l*2 which oppose those of the permanent poles at the legs *l*3 and *l*4, respectively. The attractive magnetomotive forces again draw the elements 14' and 24' into electrical contact to establish a connection between the main circuit conductors 15' and 25'. Release of the connection is accomplished by the suitable energization of conductors 16' and 17' as described in the foregoing to restore repelling poles at the opposing legs of the elements 14' and 24'.

Still another possible variation of a switch arrangement within the scope of this invention provides for an organization and operation according to those of the embodiment of either FIG. 1 or FIG. 4. In this variation only one of the supporting sheets 10 and 20 is of a flexible material, the other being rigid to provide a main support for the switch. FIG. 1 or 4 and their accompanying detailed descriptions hereinbefore provide a disclosure of such a switch arrangement with the added specification that the sheet 10 be of a rigid, electrically insulating material rather than a flexible material.

Although simple, equal turn electrical winding arrangements for achieving coincident current selection of a crosspoint were contemplated in connection with the description of specific embodiments of the invention in the foregoing, a switch construction according to this invention is equally operable in other selection modes. The winding arrangements for the elements 14 and 24 may be such as that described, for example, in the patent of T. N. Lowry, U.S. Pat. No. 3,037,085, issued May 29, 1962. In that case, each element 14 and 24 would have the energizing conductors coupled thereto in the equivalent of n and 2n turns each for what is there described as the differential excitation mode of operation.

It will thus be appreciated that what have been described are considered to be only specific illustrative embodiments of a switch construction according to the principles of this invention. Accordingly, it is to be understood that numerous modifications in addition to those indicated in the foregoing may be envisioned by those skilled in the art without departing from the spirit and scope of the invention as defined by the accompanying claims.

What is claimed is:

1. An electrical switch construction comprising a first and a second sheet arranged in spaced-apart, substantially parallel planes to present facing surfaces, at least one of said sheets being of a flexible material, a first and a second plurality of selection conductors mounted on at least one of said sheets and arranged in substantially orthogonal coordinates to define a coordinate array of crosspoints on both of said sheets, a plurality of electrical, magnetically responsive contact means arranged at said crosspoints, each of said contact means comprising a first substantially U-shaped element passing through said one of said sheets and in inductive coupling with at least one of each of said first and said second plurality of selection conductors intersecting at the crosspoint to present a first pair of contact legs at the facing surface of said last-mentioned sheet, and a second substantially "U" shaped element passing through the other of said sheets to present a second pair of contact legs opposite, respectively, said first pair of contact legs; and coordinate signal path conductors for interconnecting the U-shaped elements in respective coordinates on each of said sheets.

2. An electrical switch construction according to claim 1 in which each of said U-shaped elements is formed of a magnetic material having substantially rectangular hysteresis characteristics.

3. An electrical switch construction according to claim 1 in which the other of said sheets is formed of a nonflexible material.

4. An electrical switch construction according to claim 1 also comprising a third and a fourth plurality of selection conductors mounted on the other of said sheets and arranged in said substantially orthogonal coordinates, respectively, said second substantially U-shaped element at a crosspoint being in inductive coupling with at least one of each of said third and said fourth plurality of selection conductors intersecting at the crosspoint.

5. An electrical switch construction comprising a first and a second flexible sheet arranged in spaced-apart, substantially parallel planes to present facing surfaces, a coordinate array of substantially U-shaped, electrically conductive and magnetically responsive elements passing through each of said sheets to present a coordinate array of opposing and spaced-apart pairs of legs on said facing surfaces, a first and a second plurality of selection conductors mounted on said first sheet lying substantially in the respective sets of coordinates of said coordinate array and passing and intersecting between the pairs of legs of said U-shaped elements of said first sheet, and coordinate signal path conductors for interconnecting the U-shaped elements in one of said sets of coordinates on one of said sheets and in the other of said sets of coordinates on the other of said sheets, the opposing pairs of legs at a crosspoint being adapted to establish an electrical connection against the flexion of said sheets when oppositely magnetized by energizing currents in the selection conductors intersecting at the crosspoint.

6. An electrical switch construction according to claim 5 in which the U-shaped elements on each of said sheets are formed of a magnetic material exhibiting substantially rectangular hysteresis characteristics.

7. An electrical switch construction according to claim 5 in which the U-shaped elements on said first sheet are formed of a magnetic material exhibiting substantially rectangular hysteresis characteristics and the U-shaped elements on said second sheet are permanently magnetized.

8. An electrical switch construction according to claim 6 also comprising a third and a fourth plurality of selection conductors mounted on said second sheet lying in said respective sets of coordinates and passing and intersecting between the pairs of legs of said U-shaped elements of said second sheet.

9. An electrical switch arrangement comprising a first and a second substantially U-shaped member each formed of an electrically conductive, magnetically responsive material, said members each presenting a pair of opposing contact legs, means for supporting said members and for maintaining said pairs of legs in spaced-apart registration comprising a flexible first flat member and a second flat member arranged to present facing surfaces, the legs of said first and second U-shaped members passing through said first and second flat members from opposite surfaces, respectively, to said facing surfaces, and energizing conductor means inductively coupled to at least one of said U-shaped members adapted to create opposite magnetic poles at said opposing contact legs when energized by applied actuating currents.

10. An electrical switch arrangement according to claim 9 in which at least one of said U-shaped members is formed of a magnetic material exhibiting substantially rectangular hysteresis characteristics.

* * * * *